US005408912A

United States Patent [19]

Baity et al.

[11] Patent Number: 5,408,912

[45] Date of Patent: Apr. 25, 1995

[54] BRIDGE FOR STRINGED MUSICAL INSTRUMENTS

[75] Inventors: Harvey A. Baity, Wilkesboro; John G. Akin, Moravian Falls, both of N.C.

[73] Assignee: Akin & Baity, Moravian Falls, N.C.

[21] Appl. No.: 171,657

[22] Filed: Dec. 22, 1993

[51] Int. Cl.[6] ..... G10D 3/04

[52] U.S. Cl. ..... 84/307

[58] Field of Search ..... 84/298, 307

[56] References Cited

U.S. PATENT DOCUMENTS

| | | | |
|---|---|---|---|
| 669,902 | 3/1901 | Runkles | 84/298 |
| 1,381,187 | 6/1921 | Grover | 84/298 |
| 1,737,338 | 11/1929 | Schroeder | 84/298 |
| 2,491,991 | 12/1949 | Lundbäck | 84/307 |
| 2,786,382 | 3/1949 | Melita | 84/298 |
| 4,248,126 | 2/1981 | Lieber | 84/299 |
| 4,286,494 | 9/1981 | Jaquith | 84/309 |
| 4,385,543 | 5/1983 | Shaw et al. | 84/298 |

*Primary Examiner*—M. L. Gellner
*Assistant Examiner*—Patrick J. Stanzione
*Attorney, Agent, or Firm*—Rhodes, Coats & Bennett

[57] ABSTRACT

An improved bridge for a stringed musical instrument having a sound board. The bridge includes an elongated body portion having first and second ends. An adjustable foot is located at each end of the body portion and has a heel and a toe portion for contact with the sound board of the instrument. The bridge further includes means for selectively biasing each of the adjustable feet, whereby the contact between the sound board and the adjustable foot may be varied between the heel and toe portion of each of the feet.

12 Claims, 2 Drawing Sheets

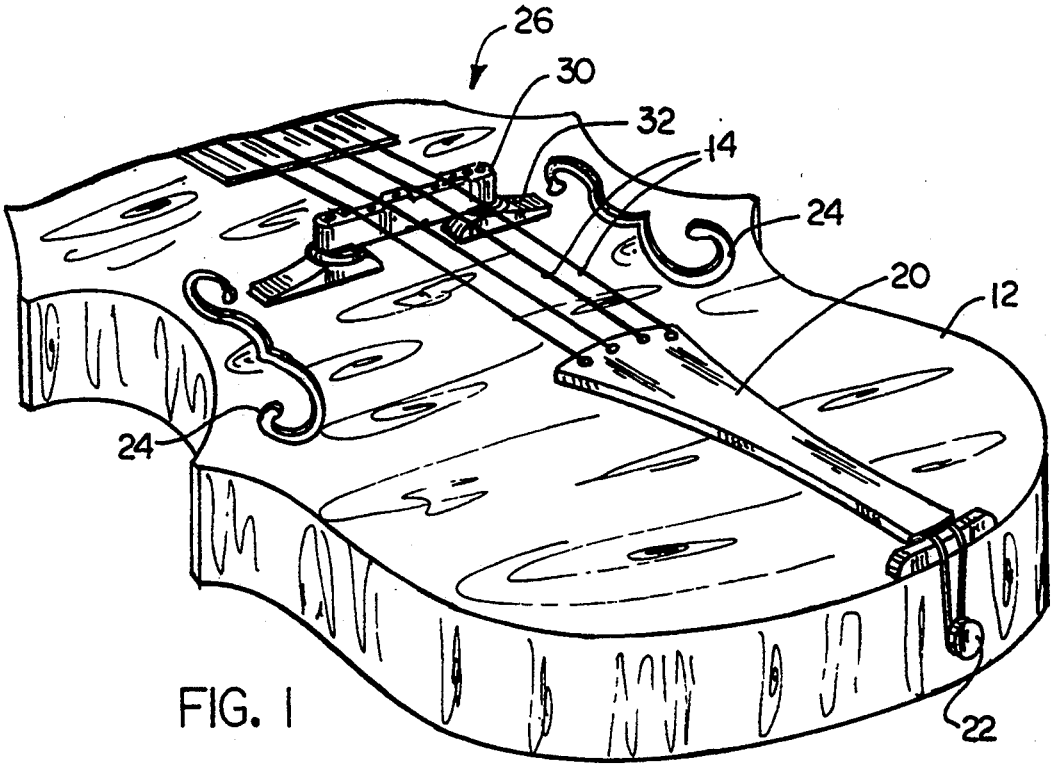
FIG. 1
FIG. 2
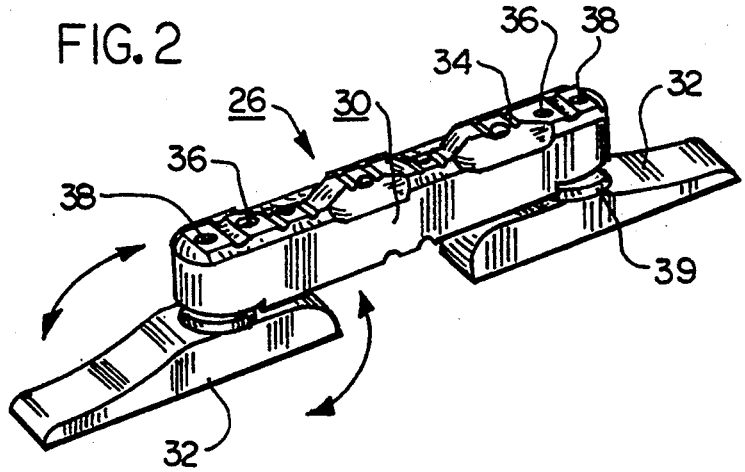

BRIDGE FOR STRINGED MUSICAL INSTRUMENTS

BACKGROUND OF THE INVENTION (1) Field of the Invention

The present invention relates generally to bridges for stringed musical instruments and, more particularly, to an adjustable bridge whose supporting base is adapted to fit a variety of contours of instrument surfaces.

(2) Description of the Prior Art

The sounding board of mandolins and similarly stringed instruments varying widely in curvature from the bouts or sides to the crest of the table. Some instruments are relatively flat while others are decidedly arched with different degrees of arching by different makers. In addition, it is frequently necessary to change or replace the bridge because of breakage or for various other reasons. While bridges are supplied in the trade in various sizes and shapes it is necessary to fit the bridge for the particular instrument for which it is intended. The process of correctly fitting the bridge, in particular the feet of the bridge, is a very difficult one and in fact is practically impossible except to the expert repairer or luthier. Many attempts have been made to provide a simple and inexpensive means for fitting a bridge by providing articulated feet.

U.S. Pat. No. 1,737,338, issued to Schrader, teaches a bridge having articulated feet so that the feet are self-adjustable to the various contours of a violin table. The feet are pivotally attached to the bottom of the base and, accordingly, pivot to fit the contours of the violin sound board.

U.S. Pat. No. 2,786,382, issued to Melita, discloses an adjustable base for use with string instruments. The base includes a pair of horizontal feet in spaced relationship to one another and joined by a flexible band. The feet are each attached to a pivotally supported threaded post which may be adjusted to raise or lower each end of the bridge. The pivoting foot accommodates varying surfaces of the violin sound board.

U.S. Pat. No. 4,286,494, issued to Jaquith, discloses an improvement in prior art bridges which includes pivotal support feet permitting the support feet to aline themselves to the contour of the instrument and includes locking means which prevents the pivoting support feet from lateral movement in the direction of the strings.

U.S. Pat. No. 669,902, issued to Runkles, discloses an adjustable bridge having a threaded rod extending therethrough and a thumb screw for adjusting the relative distance between width of the feet from one another.

Finally, U.S. Pat. No. 1,381,187, issued to Grover, discloses a bridge for stringed instruments in which the main bar in its supports are connected by slotted portions which interlocked and which a plurality of slots of the interlocking portions are of different depths so that the height of the bridge may be adjusted with respect to one end and the other. However, all of the prior art devices include free floating feet which are not capable of being biased into more musically desirable positions.

Thus, there remains a need for a new and improved bridge for stringed musical instruments includes means for adjusting the point of contact between the feet and the sound board while, at the same time, adjusting the height of the body of the bridge along its length.

SUMMARY OF THE INVENTION

The present invention is directed to an improved bridge for a stringed musical instrument having a sound board. The bridge includes an elongated body portion having first and second ends. An adjustable foot is located at each end of the body portion and has a heel and a toe portion for contact with the sound board of the instrument. The bridge further includes means for selectively biasing each of the adjustable feet, whereby the contact between the sound board and the adjustable foot may be varied between the heel and toe portion of each of the feet.

In the preferred embodiment the means for selectively biasing each of the adjustable feet includes a first threaded fastener having one end attached to the heel portion of the foot and a second threaded fastener having one end attached between the heel and toe portion of the foot, whereby the contact between the sound board and the adjustable foot may be varied between the heel and toe portion of each of the feet by the operation of at least one of the fasteners. The apparatus may further include a thumb wheel attached to the second threaded fastener, whereby the operation of the thumb wheel varies the contact between the sound board and the heel and toe portion of the foot.

Also, in the preferred embodiment, the bridge further includes means for selectively varying the height of the body from one to the other of said ends. Preferably, the means for selectively varying the height of said body from one of said ends to the other includes an elongated rod extending substantially from one end to the other end of said body and a plurality of adjustment screws extending through said rod and adjacent to said body.

Accordingly, one aspect of the present invention is to provide a bridge for a stringed musical instrument having a sound board. The bridge includes: (a) an elongated body portion having first and second ends; (b) an adjustable foot located at each end of the body portion having a heel and a toe portion for contact with the sound board of the instrument; and (c) means for selectively biasing each of the adjustable feet, whereby the contact between the sound board and the adjustable foot may be varied between the heel and toe portion of each of the feet.

Another aspect of the present invention is to provide an adjustable foot for a bridge for a stringed musical instrument having a sound board. The adjustable foot includes: (a) a foot portion located at each end of the bridge having a heel and a toe portion for contact with the sound board of the instrument; and (b) means for selectively biasing each of the adjustable feet, whereby the contact between the sound board and the adjustable foot may be varied between the heel and toe portion of each of the feet.

Still another aspect of the present invention is to provide a bridge for a stringed musical instrument having a sound board. The bridge includes: (a) an elongated body portion having first and second ends; (b) an adjustable foot located at each end of the body portion having a heel and a toe portion for contact with the sound board of the instrument; and (c) means for selectively biasing each of the adjustable feet, wherein the means for selectively biasing each of the adjustable feet includes a first threaded fastener having one end attached to the heel portion of the foot and a second threaded fastener having one end attached between the heel and toe portion of the foot, whereby the contact between the sound board and the adjustable foot may be varied between the heel and toe portion of each of the feet by the operation of at least one of the fasteners.

These and other aspects of the present invention will become apparent to those skilled in the art after a reading of the following description of the preferred embodiment when considered with the drawings.

BRIEF DESCRIPTION OF THE DRAWINGS

FIG. 1 is a perspective view of a stringed musical instrument utilizing a bridge constructed according to the present invention;

FIG. 2 is enlarged perspective view of the bridge shown in FIG. 1; and

DESCRIPTION OF THE PREFERRED EMBODIMENTS

Figure 3:
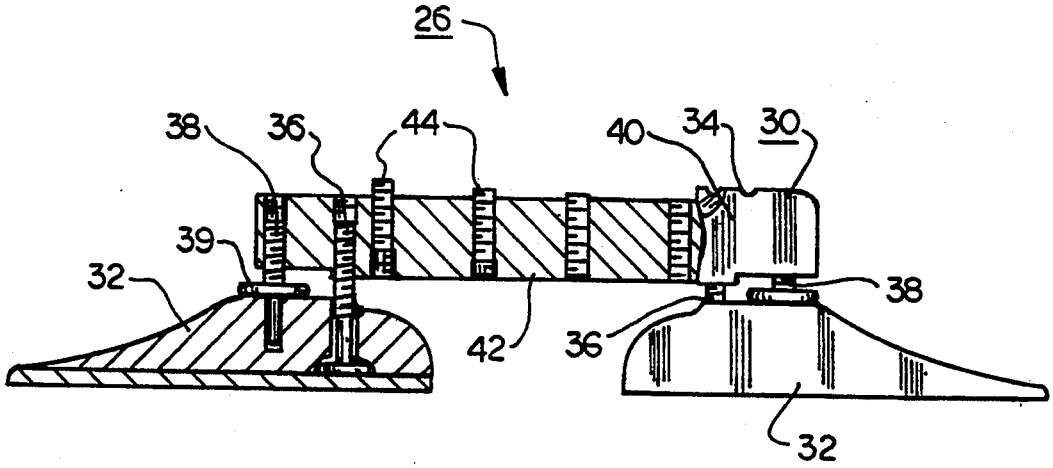
FIG. 3 is a cross sectional view of the bridge shown in FIG. 2.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, there is shown a perspective view of a stringed musical instrument utilizing a bridge that is constructed according to the present invention. Such instruments normally have a sound board 12. A plurality of strings 14 extend across the sound board 12 and are attached at one end to a peg box (not shown) and at the other end to a tail piece 20. Tail piece 20 is attached to the side of the musical instrument by a button 22. Sound holes 24 in the surface of the sounding board 12 amplify sound from the back of the instrument.

A bridge constructed according to the present invention is generally designated 26. It includes a body 30 for supporting the strings and a pair of pivotal feet 32. As best seen in FIG. 2, the body of bridge 26 includes a plurality of notches 34 for limiting the transverse movement of the string and proving a node for the vibration of the string. The bridge 26 also includes a pair of inboard 36 and outboard 38 adjustment screws located at each end. These adjustments screws extend through the body of the bridge and into the feet located at each end of the bridge. Thumb wheels 39 attached to outboard screws 38 permit that adjustment screw to be turned without the use of tools.

In operation, adjustment of inboard and outboard screws 36, 38 cause the pivotal feet 32 to be biased either toe first, heel first, or "flat footed" with respect to the surface of sound board 12. According, unlike the prior art bridges in which the feet were specifically designed to self aline with the surface of the sound board, the present invention allows the musician to adjust the contact point between the bridge and the sound board as he sees fit.

Furthermore, in the preferred embodiment, only an inboard and an outboard adjustment screw is used for each foot. This arrangement allows the toe of each foot to be rotated inward or outward in relation to the strings and gives a further degree of freedom which was specifically prevented by the prior art which always maintained the feet in line with the body.

Also in the preferred embodiment, the body of the bridge includes a notched upper portion 40 having a transverse groove for receiving a support bar 42. A plurality of threaded fasteners extend through the support bar 42 adjacent to the inner bottom edge of the notched upper portion 40. By threading these adjustment screws 44 inwardly or outwardly, the height of the notched upper portion 40 and the contact area between the support bar 42 and the upper portion 40 can both be varied along its length. A firmer or softer contact helps bring out the volume or strength of one or more courses of strings when compared to other strings.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A bridge for a stringed musical instrument having a sound board, said bridge comprising:

(a) an elongated body portion having first and second ends;

(b) an adjustable foot located at each end of said body portion having a heel and a toe portion for contact with the sound board of the instrument; and (c) means for selectively biasing and securing each of said adjustable feet, whereby the contact between the sound board and said adjustable foot may be varied between said heel and toe portion of each of said feet.

2. The apparatus according to claim 1, further including means for selectively varying the height of the upper portion of said body from one to the other of said ends.

3. The apparatus according to claim 2, wherein said means for selectively varying the height of the upper portion of said body from one of said ends to the other includes an elongated bar extending substantially from one end to the other end of said body and a plurality of adjustment screws extending through said bar and adjacent to the inner edge of the upper portion of said body.

4. The apparatus according to claim 1, wherein said body includes a plurality of transverse notches for supporting each of the strings of the instrument.

5. An adjustable foot for a bridge for a stringed musical instrument having a sound board, said foot comprising:

(a) a foot portion located at each end of the bridge having a heel and a toe portion for contact with the sound board of the instrument; and (b) means for selectively biasing and securing each of said adjustable feet, whereby the contact between the sound board and said adjustable foot may be varied between said heel and toe portion of each of said feet.

6. The apparatus according to claim 5, wherein said means for selectively biasing each of said adjustable feet includes a first threaded fastener having one end attached to the heel portion of said foot and a second threaded fastener having one end attached between said heel and toe portion of said foot, whereby the contact between the sound board and said adjustable foot may be varied between said heel and toe portion of each of said feet by the operation of at least one of said fasteners.

7. The apparatus according to claim 6, further including a thumb wheel attached to said second threaded fastener having one end attached between said heel and toe portion of said foot, whereby the operation of said thumb wheel varies the contact between the sound board and the heel and toe portion of said foot.

8. A bridge for a stringed musical instrument having a sound board, said bridge comprising:

(a) an elongated body portion having first and second ends;

(b) an adjustable foot located at each end of said body portion having a heel and a toe portion for contact with the sound board of the instrument; and (c) means for selectively biasing each of said adjustable feet, wherein said means for selectively biasing each of said adjustable feet includes a first threaded fastener having one end attached to the heel portion of said foot and a second threaded fastener having one end attached between said heel and toe portion of said foot, whereby the contact between the sound board and said adjustable foot may be varied between said heel and toe portion of each of said feet by the operation of at least one of said fasteners.

9. The apparatus according to claim 8, further including means for selectively varying the height of the upper portion of said body from one to the other of said ends.

10. The apparatus according to claim 9, wherein said means for selectively varying the height of the upper portion of said body from one of said ends to the other includes an elongated bar extending substantially from one end to the other end of said body and a plurality of adjustment screws extending through said bar and adjacent to the inner edge of the upper portion of said body.

11. The apparatus according to claim 8, wherein said body includes a plurality of transverse notches for supporting each of the strings of the instrument.

12. The apparatus according to claim 8, further including a thumb wheel attached to said second threaded fastener having one end attached between said heel and toe portion of said foot, whereby the operation of said thumb wheel varies the contact between the sound board and the heel and toe portion of said foot.

* * * * *